US005820033A

United States Patent [19]

Cooke

[11] Patent Number: 5,820,033

[45] Date of Patent: Oct. 13, 1998

[54] FUEL INJECTION NOZZLE

[75] Inventor: Michael Peter Cooke, Gillingham, United Kingdom

[73] Assignee: Lucas Industries plc, Great Britain

[21] Appl. No.: 629,532

[22] Filed: Apr. 9, 1996

[30] Foreign Application Priority Data

Apr. 28, 1995 [GB] United Kingdom ..... 9508623

[51] Int. Cl.[6] ..... B05B 1/30

[52] U.S. Cl. ..... 239/585.5; 239/124

[58] Field of Search ..... 239/585.1, 585.4, 239/585.5, 533.8, 88, 96, 124

[56] References Cited

U.S. PATENT DOCUMENTS

| | | | |
|---|---|---|---|
| 4,470,545 | 9/1984 | Deckard et al. | 239/88 |
| 4,485,969 | 12/1984 | Deckard et al. | 239/585.1 X |
| 4,618,095 | 10/1986 | Spoolstra | 239/585.1 X |
| 4,798,186 | 1/1989 | Ganser | 239/585.1 X |
| 4,905,907 | 3/1990 | Ricco | 239/533.8 |
| 4,946,106 | 8/1990 | Turchi et al. | 239/533.8 X |
| 4,993,637 | 2/1991 | Kanesaka . | |
| 5,094,215 | 3/1992 | Gustafson | 239/96 X |
| 5,265,804 | 11/1993 | Brunel | 239/585.1 X |
| 5,452,858 | 9/1995 | Tsuzuki et al. | 239/533.8 |
| 5,551,634 | 9/1996 | Raab et al. | 239/96 |
| 5,556,031 | 9/1996 | Cooke et al. | 239/533.8 X |
| 5,560,549 | 10/1996 | Ricco et al. | 239/585.1 X |

FOREIGN PATENT DOCUMENTS

| | | |
|---|---|---|
| 0 199 632 | 10/1986 | European Pat. Off. . |
| 1 326 228 | 8/1973 | France . |
| 2 208 452 | 6/1974 | France . |
| 1 290 010 | 2/1969 | Germany . |
| 2 051 944 | 5/1971 | Germany . |
| 1 491 957 | 11/1977 | Germany . |

OTHER PUBLICATIONS

English language abstracts of Document Nos. 0199632 and 2208452.

*Primary Examiner*—Andres Kashnikow
*Assistant Examiner*—Steven J. Ganey
*Attorney, Agent, or Firm*—Andrus, Sceales, Starke & Sawall

[57] ABSTRACT

A fuel injection nozzle is disclosed which comprises a valve needle slidable along a first axis to control fuel delivery by the nozzle, and an actuator including a member moveable along a second axis to control movement of the valve needle. The first and second axes are offset from one another, thus the wall of a body housing the valve needle and actuator includes a region of relatively great thickness.

14 Claims, 3 Drawing Sheets

FUEL INJECTION NOZZLE

This invention relates to a fuel injection nozzle, and particularly to a nozzle for use in the delivery of fuel to a cylinder of a diesel internal combustion engine of the type in which fuel is supplied to a high pressure accumulator by a suitable pump and is delivered from the accumulator to the fuel injection nozzles of the engine, the nozzles being arranged to be actuated, in turn, to deliver fuel to the respective cylinders of the engine.

Such a fuel injection nozzle is usually received within a bore provided in the cylinder head, thus it will be recognised that the dimensions of the nozzle are restricted.

EP 0647780 describes a nozzle in which a needle is slidable within a body and engageable with a valve seat to control the flow of fuel from a high pressure fuel supply line through the body. The end of the needle remote from the valve seat extends within a chamber, the chamber being arranged to receive fuel from the supply line through a restrictor. A hollow cylindrical element is arranged to engage with the end of the needle within the chamber, the cylindrical element being moveable under the influence of a solenoid actuator, and being biassed into engagement with the needle by means of a spring. The interior of the hollow cylindrical element is arranged to communicate with a suitable low pressure drain.

In use, when the solenoid actuator is not energized, the cylindrical element engages the end of the needle under the action of the spring, and the spring force together with the pressure of fuel acting against the end of the needle hold the needle in engagement with the valve seat.

On energization of the solenoid actuator, the cylindrical element is lifted from the end of the needle thus permitting fuel from the chamber to escape through the cylindrical member to drain. As the chamber communicates with the fuel supply line through a restrictor, the fuel pressure within the chamber falls sufficiently to permit the needle to leave the valve seat due to the fuel pressure acting against a portion of the needle adjacent the valve seat.

In order to terminate delivery, the solenoid actuator is de-energized resulting in the cylindrical element re-engaging the needle under the action of the spring. Such re-engagement cuts off the communication between the chamber and the low pressure drain, permitting the pressure in the chamber to increase. The increased pressure within the chamber together with the spring force act to close the valve by moving the needle back into engagement with the valve seat.

As the pressure in the fuel supply line is very high, and the fuel supply line must extend past the solenoid actuator within a relatively thin part of the body, there is a risk of the body of the nozzle rupturing due to the pressure within the line. It is an object of the invention to provide a nozzle in which this problem is reduced.

According to the present invention there is provided a fuel injection nozzle comprising a body housing a valve needle which is moveable along a first axis, and an actuator which is moveable along a second axis, wherein the first and second axes are offset from one another.

The actuator conveniently comprises a solenoid actuated valve, the valve member of which is moveable along the second axis.

It will be understood that if the first axis extends along the centerline of the body and the second axis is offset from the first axis, the wall thickness of the body around the solenoid actuator of the valve is not uniform, thus it is possible to provide a high pressure fuel line in a region of the wall of relatively great thickness thus reducing the risk of the body rupturing.

The invention will further be described, by way of example, with reference to the accompanying drawings, in which.

Figure 1:
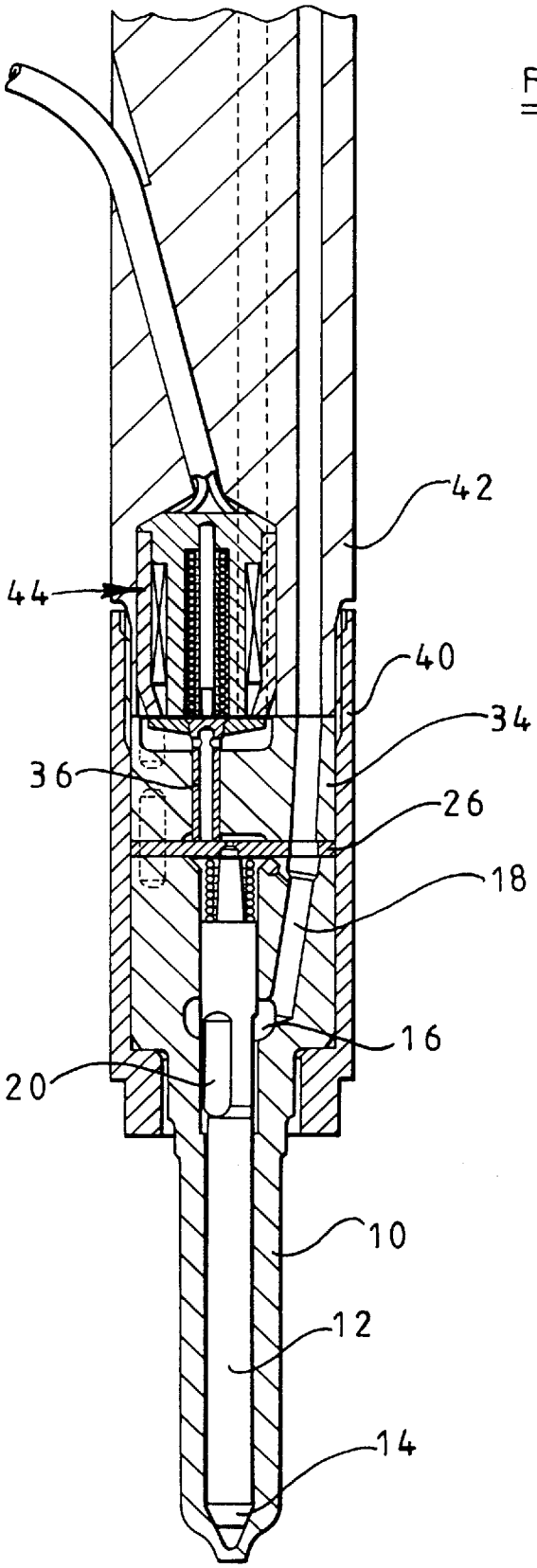
FIG. 1 is a cross-sectional view of a nozzle in accordance with a first embodiment of the invention.
Figure 2:
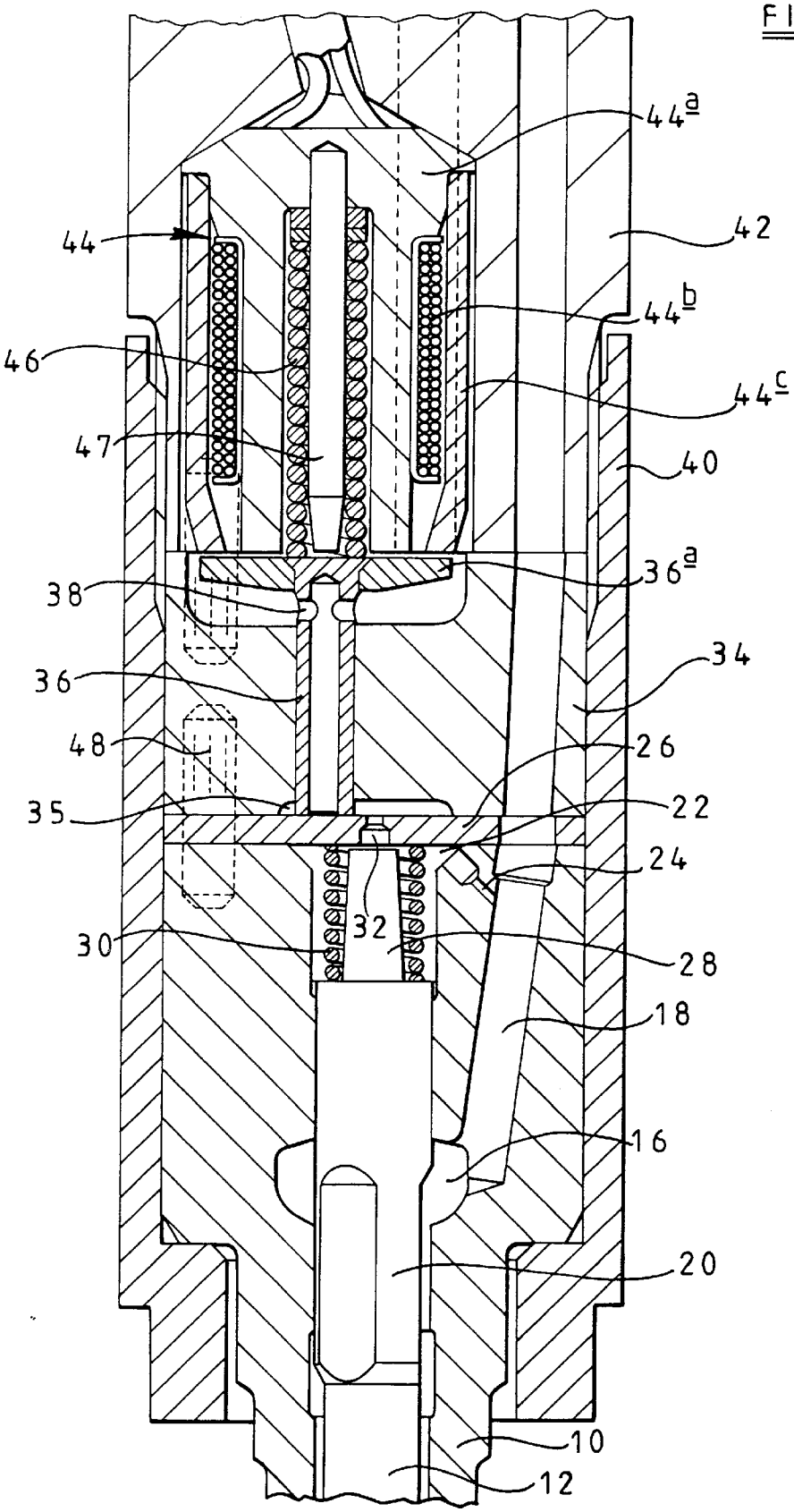
FIG. 2 is an enlargement of part of the nozzle of FIG. 1.

The fuel injection nozzle illustrated in FIGS. 1 and 2 comprises a valve body 10 including a first region of relatively narrow diameter and a second, enlarged region. The valve body 10 is provided with a bore which extends through both the first and second regions, the bore terminating at a position spaced from the free end of the first region. An elongate valve needle 12 is slidable within the bore, the valve needle 12 including a tip region 14 which is arranged to engage a valve seat defined by the inner surface of the valve body 10 adjacent the blind end of the bore. The valve body 10 is provided with one or more apertures communicating with the bore, the apertures being positioned such that engagement of the tip 14 with the valve seat prevents fluid escaping from the valve body 10 through the apertures, and when the tip 14 is lifted from the valve seat, fluid may be delivered through the apertures.

As shown clearly in FIG. 2, the valve needle 12 is shaped such that the region thereof which extends within the first region of the valve body 10 is of smaller diameter than the bore to permit fluid to flow between the valve needle 12 and the inner surface of the valve body 10. Within the second region of the valve body 10, the valve needle 12 is of larger diameter, substantially preventing fluid flowing between the valve needle 12 and the valve body 10.

In the second region of the valve body 10, an annular gallery 16 is provided, the annular gallery 16 communicating with a fuel supply line 18 which is arranged to receive high pressure fuel from an accumulator of an associated fuel delivery system. In order to permit fuel to flow from the gallery 16 to the first region of the valve body 10, the valve needle 12 is provided with a fluted region 20 which permits fuel to flow from the annular gallery 16 to the first part of the valve body 10, and also acts to restrict lateral movement of the valve needle 12 within the valve body 10 but not restricting axial movement thereof.

A chamber 22 is provided within the second region of the valve body 10 at a position remote from the first region thereof, the chamber 22 communicating with the high pressure fuel line 18 through a restrictor 24. As shown in FIG. 2, the chamber 22 is provided at an end of the valve body 10, the chamber 22 being closed by a plate 26.

The end of the valve needle 12 remote from the tip 14 thereof, is provided with a reduced diameter projection 28, the projection 28 guiding a compression spring 30 which is engaged between the valve needle 12 and the plate 26 to bias the valve needle 12 to a position in which the tip 14 thereof engages the valve seat.

A body 34 engages the side of the plate 26 opposite that engaged by the valve body 10, the body 34 and plate 26 together defining a chamber 35 which communicates with the chamber 22 through an aperture 32. The body 34 is further provided with a bore which is spaced apart from the axis of the body 34 and within which a valve member 36 is slidable. The valve member 36 comprises a cylindrical rod provided with an axially extending blind bore, the open end of the bore being able to communicate with the chamber 35 when the valve member 36 is lifted such that the end thereof is spaced from the plate 26, such communication being broken when the valve member 36 engages the plate 26. A pair of radially extending passages 38 communicate with the blind bore adjacent the blind end thereof, the passages 38 communicating with a chamber which is connected to a suitable low pressure drain.

The body 34, plate 26 and valve body 10 are mounted on a nozzle holder 42 by means of a cap nut 40 which engages the end of the second region of the valve body 10 adjacent its interconnection with the first region thereof. The nozzle holder 42 includes a recess within which a solenoid actuator 44 is provided.

As illustrated in FIG. 2, the solenoid actuator 44 comprises a generally cylindrical core member 44*a* including an axial blind bore, windings 44*b* being wound upon the core member 44*a* and being connected to a suitable controller, and a cylindrical yoke 44*c* extending around the core member 44*a* and windings 44*b*. The faces of the core member 44*a* and yoke 44*c* facing the valve member 36 define pole faces.

The valve member 36 carries an armature 36*a* such that upon energization of the solenoid actuator 44, the armature 36*a* and valve member 36 are lifted such that the valve member 36 disengages the plate 26. On de-energizing the solenoid actuator 44, the valve member 36 returns to its original position under the action of a spring 46 received within the blind bore of the core member 44*a*.

A movement limiter 47 is also received within the blind bore of the core member 44*a*, the movement limiter 47 being arranged to limit movement of the valve member 36 against the action of the spring 46 in order to prevent the armature 36*a* contacting the pole faces of the core member 44*a* and yoke 44*c*.

As shown in the drawings, the supply line 18 comprises bores provided in the nozzle holder 42, body 34, plate 26 and valve body 10. In order to ensure that these bores align with one another, pins 48 are provided, the pins 48 being received within suitable recesses provided in each of the nozzle holder 42, body 34, plate 26 and valve body 10.

In use, in the position shown in FIG. 2 the valve needle 12 is biased by the spring 30 such that the tip 14 thereof engages the valve seat and thus delivery of fuel from the apertures does not occur. In this position, the pressure of fuel within the chamber 22 is high, and hence the force acting against the end of the valve needle 12 due to the fuel pressure, and also due to the resilience of the spring 30 is sufficient to overcome the upward force acting on the valve needle 12 due to the high pressure fuel acting against the angled surfaces of the valve needle 12.

In order to lift the tip 14 of the valve needle 12 away from the valve seat to permit fuel to be delivered from the apertures, the solenoid actuator 44 is energized to lift the valve member 36 against the action of the spring 46 such that the end of the valve member 36 is lifted away from the plate 26. Such lifting of the valve member 36 permits fuel from the chamber 35 and hence the chamber 22 to escape to drain through the bore of the valve member 36 and passages 38. The escape of fuel from the chamber 22 reduces the pressure therein, and due to the provision of the restrictor 24, the flow of fuel into the chamber 22 from the fuel supply line 18 is restricted. As the pressure within the chamber 22 falls, a point will be reached at which the force applied to the valve member 12 due to the pressure within the chamber 22 in combination with that applied by the spring 30 is no longer sufficient to retain the tip 14 of the valve member 12 in engagement with the valve seat, and hence a further reduction in pressure within the chamber 22 will result in the valve needle 12 being lifted to permit fuel to be delivered from the apertures.

If a low initial injection rate is desired, this may be achieved by arranging the solenoid actuator 44 to lift the valve member 36 by only a small amount, thus the flow of fuel from the chamber 22 to drain is restricted. Similarly, the aperture 32 may be of restricted diameter so as to restrict the flow of fuel from the chamber 22.

As the valve needle 12 lifts, the projection 28 approaches the aperture 32 restricting the flow of fuel therethrough. It will be recognised that this has the effect of decelerating the valve needle 12 towards the end of its travel.

In order to terminate delivery, the solenoid actuator 44 is de-energized and the valve member 36 moved downwards under the action of the spring 46 until the end thereof engages the plate 26. Such movement of the valve member 36 breaks the communication of the chamber 35 with the drain, and hence the pressure within the chamber 35 and chamber 22 will increase, a point being reached at which the force applied to the valve needle 12 due to the pressure within the chamber 22 and due to the spring 30 exceeds that tending to open the valve, and hence the valve needle 12 will move to a position in which the tip 14 thereof engages the valve seat to prevent further delivery of fuel.

It will be recognised from the above description and from FIGS. 1 and 2 that since the valve member 36 and solenoid actuator 44 are not coaxial with the valve needle 12, the nozzle holder 42 and body 34 each include a region of relatively large wall thickness compared to the conventional arrangement and by arranging for the supply line 18 to extend within the relatively thick part of the wall, the risk of rupture of the injector due to the application of high pressure fuel to the fuel supply line 18 is reduced.

Under normal circumstances, the end of the projection 28 is prevented from engaging the plate 26 by the flow of fuel through the aperture 32 tending to push the valve needle 12 away from the plate 26. There is the risk, however, that if the end of the projection 28 engages the plate 26 thus preventing or restricting the flow of fuel through the aperture 32, on de-energizing the solenoid actuator 44, the area of the valve needle 12 upon which the pressure of fuel within the chamber 22 acts is reduced, and hence there is the risk that the tip 14 of the valve needle 12 may remain lifted from the valve seat and so delivery of fuel from the apertures of the valve body 10 may not be terminated. The arrangement illustrated in FIG. 3 is intended to overcome this disadvantage.

Figure 3:
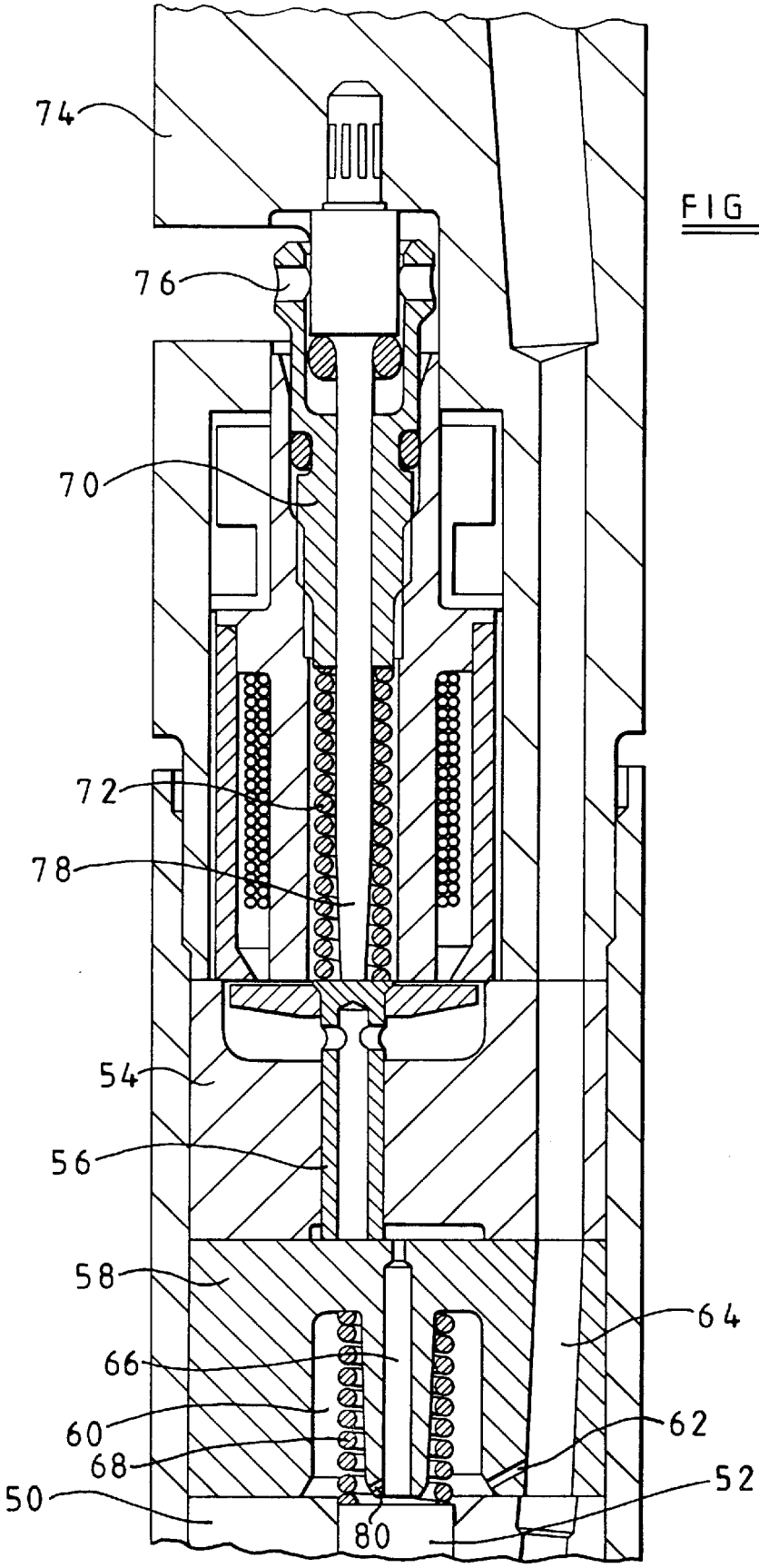
FIG. 3 is a view similar to FIG. 2 of a second embodiment.

The injector illustrated in FIG. 3 is similar to that illustrated in FIGS. 1 and 2, and only the differences between the two injectors will be described in detail.

The embodiment illustrated in FIG. 3 comprises a valve body 50 similar to that illustrated in FIGS. 1 and 2. The valve body 10 houses a valve needle 52 which is slidable with respect thereto in order to control the delivery of fuel from apertures provided in the valve body 50.

The injector further comprises a body 54 which is substantially identical to the body 34 of the embodiment illustrated in FIGS. 1 and 2, the body 54 housing a valve member 56 which is slidable with respect thereto.

In between the body 54 and valve body 50, an additional body 58 is provided, the additional body 58 being provided with an annular chamber 60 which communicates through a restrictor 62 with a high pressure delivery line 64. The additional body 58 further includes an axially extending through bore 66.

As shown in FIG. 3, the annular chamber 60 is defined by a generally cylindrical recess provided in the additional body 58, the body 58 including an integral projection which extends within the cylindrical recess to define the annular chamber 60, the through bore 66 extending through the projection. A compression spring 68 is received within the annular chamber 60, the projection acting as a guide for the compression spring 68. The compression spring 68 engages with both the additional body 58 and with the end of the valve needle 52 to bias the valve needle 52 towards a position in which the tip thereof engages the valve seat of the valve body 50.

It will be recognised that the valve needle 52 may move against the action of the spring 68 to engage the end of the projection and thus close the through bore 66. In order to reduce the risk of the valve needle 52 becoming stuck in the open position, a passage 80 is provided between the through bore 66 and the annular chamber 60 thus even when the end of the valve needle 52 engages the end of the projection, the through bore 66 is subject to substantially the same pressure as the annular chamber 60 and hence the part of the valve needle 52 which would otherwise be covered by the projection is subject to substantially the same pressure as that portion of the valve needle 52 which is not covered by the projection.

In addition to reducing the risk of the valve needle 52 becoming stuck in the open position, the arrangement illustrated in FIG. 3 is also advantageous in that a wide range of nozzle body designs may be used without significantly effecting the performance of the injector. Further, the provision of the spring within the additional body 58 rather than on the valve needle 52 allows standard nozzle bodies to be used.

The arrangement illustrated in FIG. 3 further differs from that illustrated in FIGS. 1 and 2 in that an adjustable stop 70 is provided, the adjustable stop 70 being used to adjust the prestressing of a spring 72 engaged between the stop 70 and the end of the valve member 56 in order to adjust the length of time over which fuel delivery occurs for a given pulse length of current applied to the solenoid. In order to adjust the position of the adjustable stop 70 a tommy bar or the like is inserted into a recess provided in the nozzle holder 74 of this embodiment to engage an end region 76 of the adjustable stop 70. The adjustable stop 70 is a clearance fit around a movement limiter 78 which is rigidly supported within the nozzle holder 74. The adjustment stop 70 is in screw-threaded engagement with the core member of the solenoid actuator to move the stop 70 in an axial direction when rotated using the tommy bar or other tool. The purpose of the movement limiter 78 is to restrict upward movement of the valve member 56 against the action of the spring 72 in order to ensure that the armature associated with the valve member 56 is prevented from contacting the core and yoke of the solenoid actuator.

As with the embodiment illustrated in FIGS. 1 and 2, as the solenoid actuator and valve member 56 are not coaxial with the valve needle 52, the nozzle holder 74 and body 54 include regions of relatively great wall thickness and thus by providing the high pressure fuel supply line 64 in the region of relatively great wall thickness, the risk of rupture of the injector due to the application of high pressure fuel to the fuel supply line 64 is reduced.

In both of the described embodiments, the flow of fuel through the injector to drain has the effect of cooling the injector. If additional cooling is required, fuel from a low pressure source can be arranged to flow through the injector.

I claim:

1. A fuel injection nozzle comprising a body defining a supply passage and housing a valve needle which is moveable along a first axis between a seated position and a lifted position, the body and surface associated with the valve needle defining a first, control chamber communicating with the supply passage, a second chamber arranged to communicate with the first chamber through passage means, the passage means being located such that movement of the valve needle to the lifted position causes the passage means to be obscured by the said surface, and by-pass passage means whereby communication between the first and second chambers is maintained when the valve needle occupies its lifted position.

2. A nozzle as claimed in claim 1, further comprising an actuator which comprises a solenoid actuated valve including a valve member which is moveable along a second axis offset from the first axis.

3. A nozzle as claimed in claim 2, wherein the valve member comprises a tubular member having an end which is sealingly engageable with a surface.

4. A nozzle as claimed in claim 1, wherein the first chamber is arranged to receive high pressure fuel through a restrictor.

5. A nozzle as claimed in claim 1, wherein the by-pass means comprises an additional passage arranged to communicate with the passage means.

6. A nozzle as claimed in claim 1, wherein when the valve needle occupies its lifted position, the said surface associated with the valve needle engages a lift stop.

7. A fuel injection nozzle comprising a body defining a supply passage and housing a valve needle which is moveable along a first axis between a seated position and a lifted position, and an actuator which is moveable along a second axis, wherein the first and second axes are offset from one another, the actuator comprising a solenoid actuated valve including a valve member which is moveable along the second axis, the valve needle including an end region which is received within a first chamber which communicates with the supply passage, the solenoid actuated valve being operable to control the fuel pressure within the first chamber, the nozzle further comprising a second chamber and passage means interconnecting the first and second chambers, the solenoid actuated valve being arranged to control the fuel pressure in the first chamber by controlling the fuel pressure in the second chamber, wherein the passage means is located such that movement of the valve needle to its lifted position causes the passage means to be obscured by the said surface, the nozzle further comprising by-pass passage means whereby communication between the first and second chambers is maintained when the valve needle occupies its lifted position.

8. A nozzle as claimed in claim 7, wherein the by-pass passage means comprises an additional passage arranged to communicate with the passage means.

9. A fuel injection nozzle comprising a body housing a valve needle which is moveable along a first axis, the body and a surface associated with the valve needle defining a first control chamber and an actuator which is moveable along a second axis offset from the first axis, the actuator controlling the operation of a solenoid actuated valve having a tubular valve member defining a flow path and moveable along the second axis, an end of the tubular valve member being sealingly engageable with a flat surface constituting a wall of a second chamber which communicates with the first chamber, engagement of the end of the tubular valve member with the flat surface controlling the fuel pressure within the first chamber by controlling communication between the second chamber and the flow path of the tubular valve member.

10. A nozzle as claimed in claim 9, wherein the valve needle includes an end region which is received within a first, control chamber, the solenoid actuated valve being operable to control the fuel pressure within the first chamber.

11. A nozzle as claimed in claim 10, wherein the first chamber is arranged to receive high pressure fuel through a restrictor.

12. A fuel injection nozzle comprising a body housing a valve needle which is moveable along a first axis, and an actuator which is moveable along a second axis offset from the first axis, the actuator controlling the operation of a solenoid actuated valve having a tubular valve member defining a flow path and moveable along the second axis, an end of the tubular valve member being sealingly engageable with a flat surface constituting a wall of a second chamber, engagement of the end of the tubular valve member with the flat surface controlling communication between the second chamber and the flow path of the tubular valve member, wherein the valve needle includes an end region which is received within a first, control chamber, the solenoid actuated valve being operable to control the fuel pressure within the first chamber, further comprising passage means interconnecting the first and second chambers, the solenoid actuated valve being arranged to control the fuel pressure in the first chamber by controlling the fuel pressure in the second chamber.

13. A nozzle as claimed in claim 12, wherein the passage means includes means for preventing the valve needle from preventing fuel flow between the first and second chambers.

14. A nozzle as claimed in claim 13, wherein the preventing means comprises an additional passage arranged to communicate with the passage means.

* * * * *